US005355576A

United States Patent [19]

Miller

[11] Patent Number: 5,355,576

[45] Date of Patent: Oct. 18, 1994

[54] GUARDRAIL ASSEMBLY METHOD AND DEVICE

[76] Inventor: Jack J. Miller, 17638 S. Redland Rd., Oregon City, Oreg. 97045

[21] Appl. No.: 24,520

[22] Filed: Mar. 1, 1993

[51] Int. Cl.[5] ..... B23P 11/00; B23P 19/00

[52] U.S. Cl. ..... 29/431; 29/469; 29/525.1; 29/819; 29/822; 180/324

[58] Field of Search ..... 29/429, 469, 525.1, 29/819, 897.35, 431, 822; 180/321, 324; 414/745.4, 745.5; 256/13.1

[56] References Cited

U.S. PATENT DOCUMENTS 4,093,082 6/1978 Goodsell ..... 414/745.5
4,362,435 12/1982 Henry ..... 414/745.5 X
5,190,118 3/1993 Yelton ..... 180/321 X

*Primary Examiner*—Tom Hughes
*Attorney, Agent, or Firm*—Keith A. Cushing

[57] ABSTRACT

Guardrail assembly is performed by a vehicle carrying an inventory of guardrail sections and guardrail support blocks. The vehicle moves along a series of prepositioned guardrail posts and includes a side-mounted support frame allowing joining of guardrail sections and deployment rearward of a continuous ribbon of joined guardrail sections. As the continuous ribbon of joined guardrail sections is deployed, it is urged laterally outward and against attachment sites of the series of prepositioned guardrail posts. The continuous ribbon is then attached to the guardrail post, including mounting of an intermediate support block. The assembly and mounting under the disclosed method and apparatus is approximately half that of conventional guardrail assembly and mounting.

14 Claims, 3 Drawing Sheets

GUARDRAIL ASSEMBLY METHOD AND DEVICE

BACKGROUND OF THE INVENTION

The present invention relates generally to roadway construction method and apparatus, and particularly to a method and apparatus for guardrail assembly and mounting to guardrail posts.

Guardrails are constructed along roadways to prevent unintended exit of automobiles from the roadway. For example, guardrails may be placed along a roadway to prevent an automobile from falling into a ravine or to prevent an automobile from traveling into an opposing flow of traffic. Guardrails are particularly important on curved sections of a roadway where a greater likelihood of inadvertent roadway departure. Indeed, the greater the roadway curvature, the greater the need for guardrails therealong.

FIGS. 1A and 1B illustrate the basic structure of a typical guardrail assembly. In FIG. 1A, a series of guardrail posts 10, one being shown in FIG. 1A, are positioned along a roadway 12. Each guardrail post 10 is partially buried in the earth 14 and includes an upstanding exposed portion 10*a*. A guardrail support block 16 attaches to the side of post 10, extending toward roadway 12, as a mounting site for a guardrail 18. A post bolt 20 captures the guardrail 18, block 16 and upper portion 10*a* of post 10 to secure the rail 18 in a given construction and position relative to roadway 12. Thus, each post bolt 20 includes a bolt 20*a* of enough length to pass through the guardrail 18, support block 16 and guardrail post 10. Typically the bolt 20*a* includes a square cross-sectional head portion fitting closely within a corresponding square aperture of guardrail 18 whereby the square aperture of guardrail 18 holds bolt 20*a* against rotation while the nut 20*b* is tightened with, for example, an impact wrench.

Turning to FIG. 1B, the guardrail 18 comprises a series of rail sections 22, two such sections 22*a* and 22*b* being shown in FIG. 1B. Adjacent sections 22 are joined at an overlapping joint 24 by way of splice bolts 26 therethrough. More particularly, splice bolts 26 include a bolt 26*a* and a nut 26*b*. The bolt 26*a* includes a square cross-sectional head portion fitting closely within square cross-sectional apertures of the sections 22 to be joined. In this manner, the splice bolt 26 is tightened by, for example, an impact wrench applied to the nut 26*b*. Each overlapping joint 24 typically coincides with a post 10, and an additional post 10 typically supports a midpoint of each section 22. Thus, each guardrail section 22 includes at each end a set of bolt apertures for the post bolt 20 and splice bolts 26 to attach the guardrail 18 to a block 16 and post 10 and to form the overlapping joint 24. Also, each section 22 includes a bolt aperture at its midpoint for a post bolt 20 to attach to a block 16 and post 10.

The conventional process of guardrail assembly and mounting typically includes two independent work crews. A post placement crew moves along the roadway placing the posts 10 in the proper spacing, i.e., corresponding to the length of sections 22 to locate posts 10 coincident with each overlapping joint 24 and each midpoint of each section 22. A guardrail assembly crew follows the post placement crew. This second crew must form the overlapping joints 24 and mount the guardrail 18 and blocks 16 to the posts 10. This is traditionally accomplished by manually mounting each section 22 one piece at a time. Thus, the guardrail assembly crew would mount a first section 22 at an end of the guardrail to be constructed, including mounting at its midpoint to a guardrail post 10 and block 16. The unsupported end of this section 22 is then held against a next block 16 and post 10 while a next section 22 is manually located and aligned to bring the two sections 22 together for proper formation of the overlapping joint 24. Once so aligned, the splice bolts 26 and post bolt 20 may be secured to the assembly. The crew continues moving sequentially along the guardrail 18 attaching a single section 22 at a time. Problems typically encountered in this assembly process include difficulty in maintaining alignment of the apertures of the guardrails receiving the bolts 20 and 26, especially on tightly curved roadways.

The post placement crew typically moves much faster than the guardrail assembly crew. A guardrail assembly crew operating according to conventional guardrail assembly practice is a bottleneck in the guardrail construction process. It is estimated that conventional guardrail assembly methods require approximately 0.2 hours per foot of guardrail constructed. It is typical for the post placement crew to work well ahead of the guardrail assembly crew, the guardrail assembly crew always striving to keep the construction project on its time and cost schedule.

It would be desirable, therefore, to improve the guardrail assembly process. In particular, it would be desirable to expedite such process so that a guardrail assembly crew operates at least as fast the post placement crew to reduce the overall time required for guardrail construction. As may be appreciated, the time required to execute a given construction project directly affects overall construction cost. The subject matter of the present invention is directed to improved execution time in the guardrail assembly process, i.e., in the ability of a guardrail assembly crew to mount the support blocks and joined guardrail sections to the guardrail posts previously positioned by a post placement crew.

SUMMARY OF THE INVENTION

In accordance with one aspect of a preferred embodiment of the present invention, guardrail assembly and mounting to preexisting guardrail posts is accomplished by a moving support frame allowing the splicing or joining of guardrail sections prior to attachment to the post. The method and apparatus permits construction of a continuous ribbon of guardrail sections maintained substantially at the intended guardrail height and mounting of this continuous ribbon to guardrail posts as the support frame moves along guardrail posts. Thus, the guardrail is preassembled in its intended orientation and at its intended height prior to attachment, it is then moved against the guardrail posts, and intervening support blocks, for mounting in continuous and single-pass fashion.

Guardrail assembly under the present invention can be executed approximately twice as fast as conventional guardrail assembly methods. Under the method of the present invention, a guardrail assembly crew can operate at least as fast as a guardrail post placement crew. As a result, the guardrail assembly crew need not be a production bottleneck in guardrail construction. Overall construction time is reduced, being then essentially a function of the conventionally faster guardrail post placement time.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

Figure 1A:
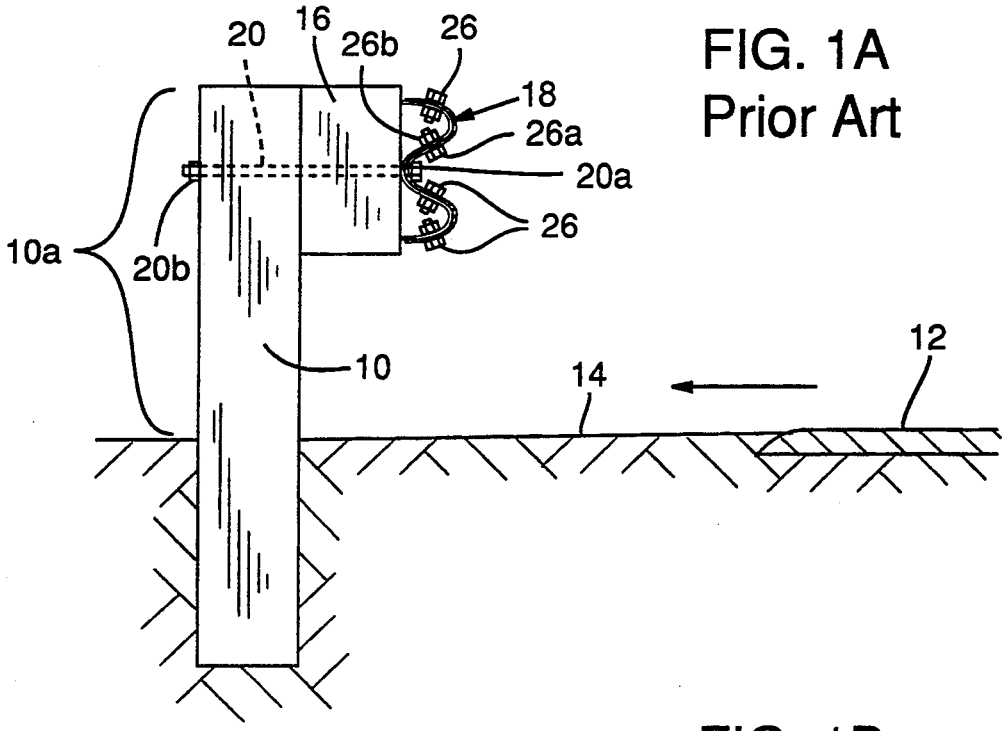
FIG. 1A Prior Art
FIG. 1A is a cross sectional view of a guardrail showing mounting to a guardrail post and a support block according to conventional construction.
Figure 1B:
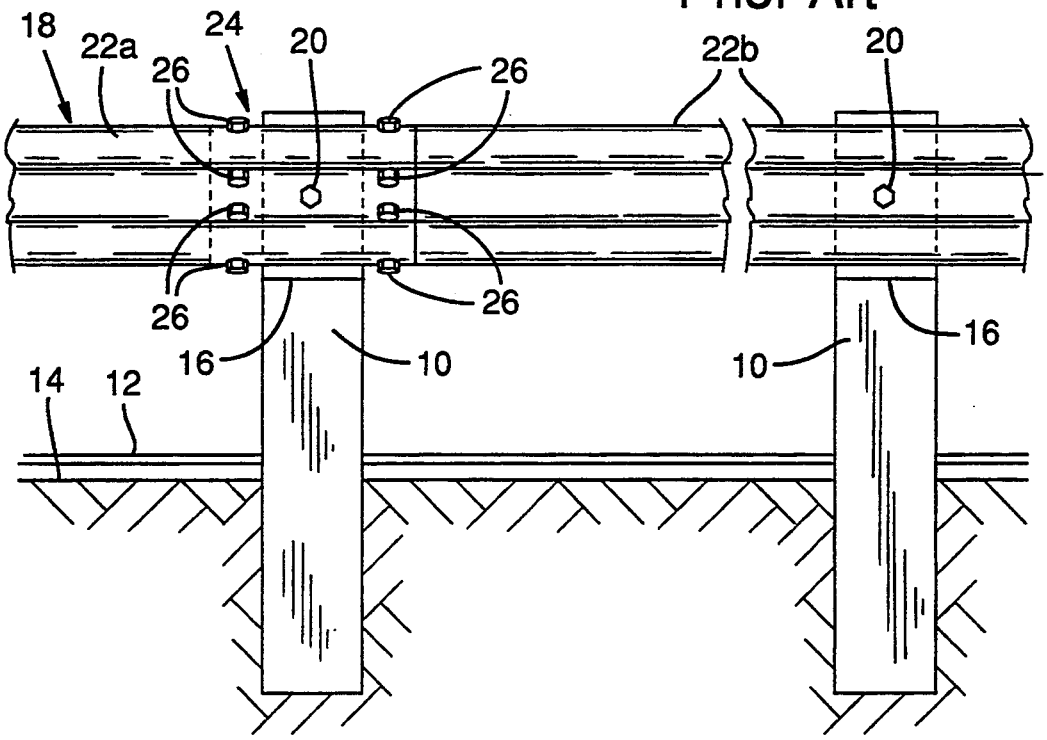
FIG. 1B Prior Art
FIG. 1B is a face view of the guardrail assembly of FIG. 1A as taken along lines 1B—1B of FIG. 1A.

The method and apparatus of the present invention results in a guardrail arrangement according to conventional construction, e.g., such as illustrated in FIGS. 1A and 1B. The method and apparatus can be applied, however, to a variety of guardrail types, e.g., can be used for single-beam rails and tri-beam rails.

Figure 2:
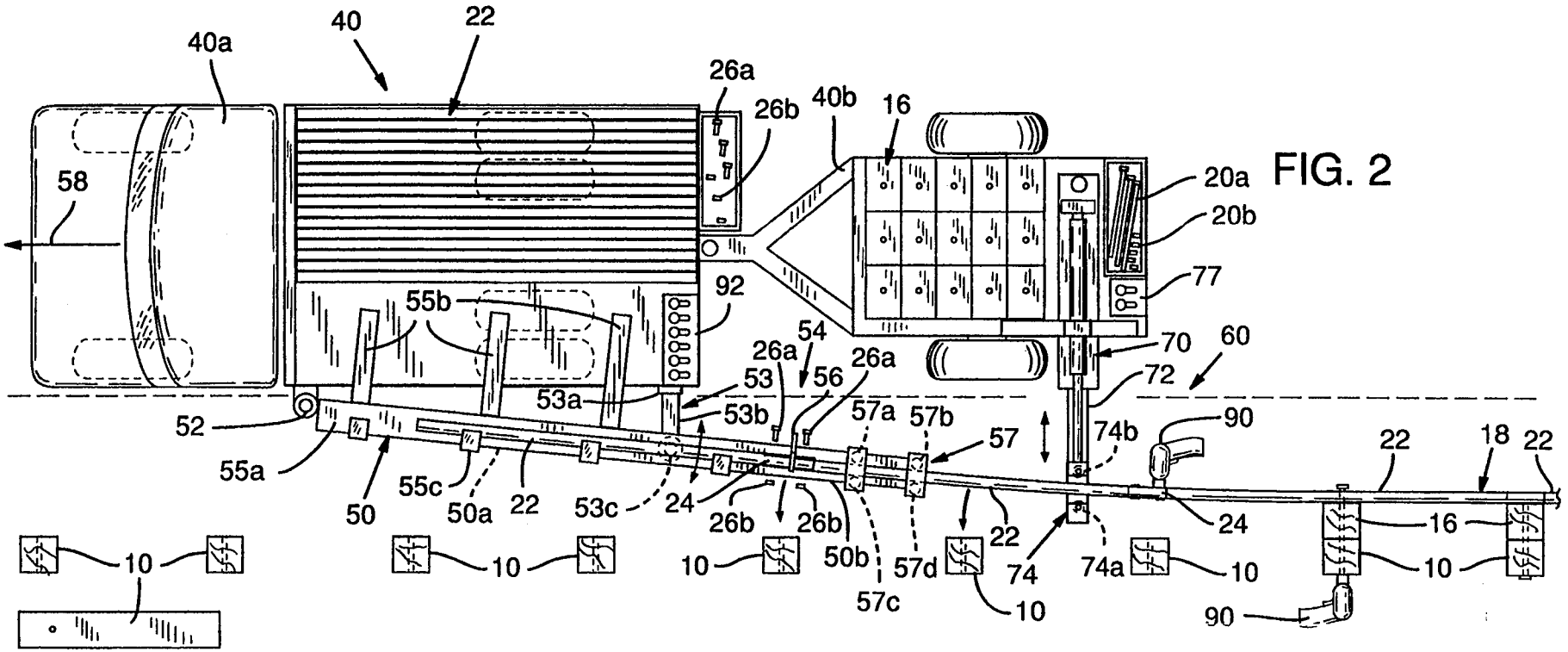
FIG. 2 is a top plan view illustrating a guardrail assembly and mounting apparatus according to the present invention.
Figure 3:
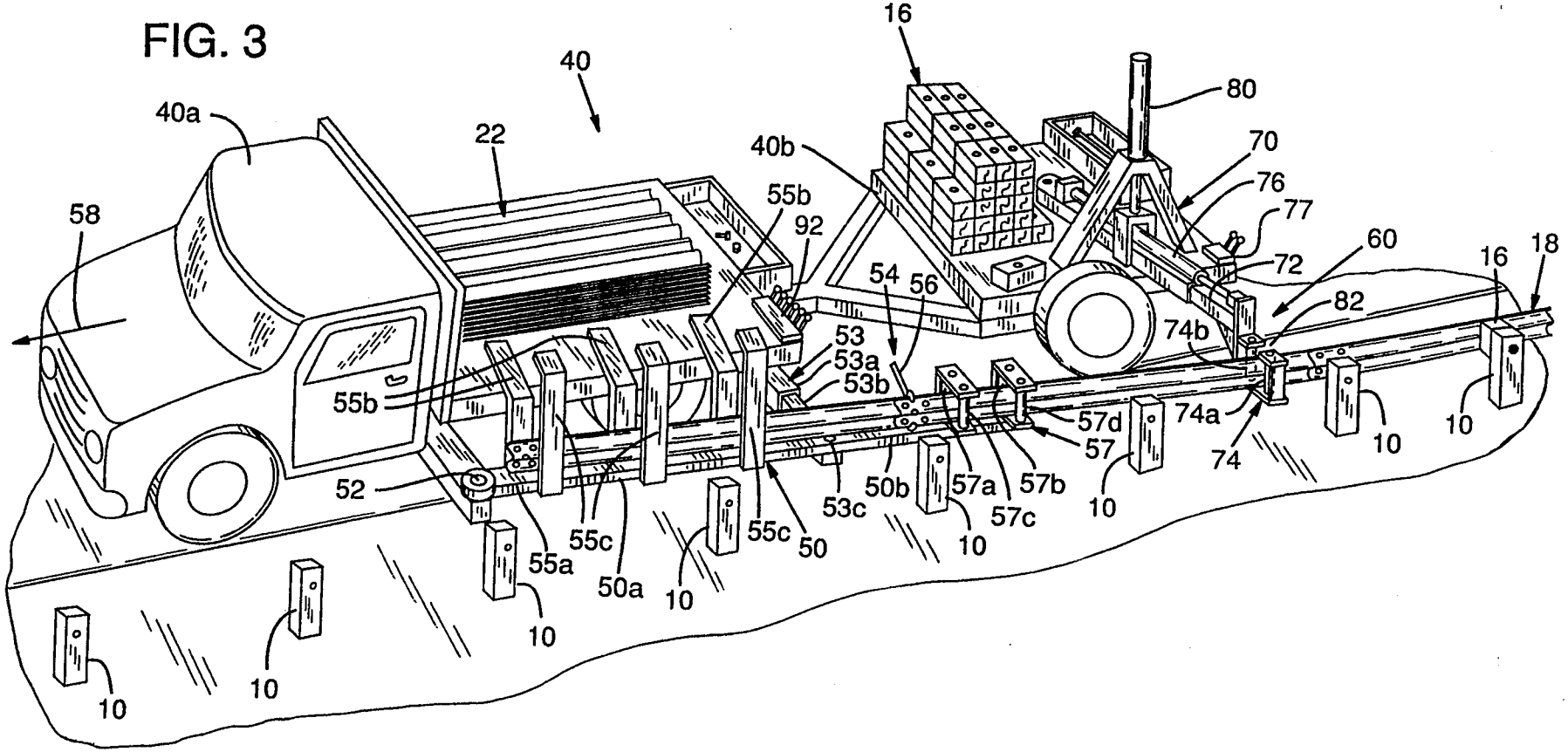
FIG. 3 is a perspective view of the arrangement of FIG. 2.

In FIGS. 2 and 3, a transport vehicle 40, including in this embodiment a flatbed truck 40*a* and trailer 40*b*, carries an inventory of guardrail sections 22 and support blocks 16. The vehicle 40 moves along a series of prepositioned guardrail posts 10. Vehicle 40 carries a side-mounted rail support frame 50. Frame 50 is pivotally attached to vehicle 40 at a forward pivot pin 52 allowing horizontal, and some slight vertical, pivoting of frame 50 about the point 52. A horizontal telescopic support 53 couples the vehicle 40 and support frame 53, in the illustrated embodiment at the rear end of flat bed truck 40*a*, to provide vertical support for the frame 50, yet permit pivoting of frame 50 in a horizontal plane about the point 52. Support 53 includes an outer sleeve 53a affixed to the vehicle 40 and an inner sleeve 53b slidably disposed within the outer sleeve 53*a*. The inner sleeve is then pivotally coupled by pivot pin 53*c* at its distal end to the frame 50 to allow pivoting movement of frame 50 relative to vehicle 40.

The support frame 50 includes a base beam 55*a*, a set of generally upstanding inside guide ribs 55*b*, and a set of generally upstanding outside guide ribs 55*c*. The base beam 55*a* provides the point of attachment for the pivot pins 52 and 53*c* and carries the guide ribs 55*b* and 55*c*. The inside guide ribs 55*b* include horizontally extending sections slidably resting over the bed of truck 40*a* to prevent dropping of sections 22 between vehicle 40 and frame 50. The entire arrangement of beam 55*a* and guide ribs 55*b* and 55*c* pivot as forward portion 50*a* of the frame 50. Thus, beam 55*a* and guides 55*b* and 55*c* provide a trough for receiving the section 22. This allows each section 22 to be thrown into frame 50 and assume the required orientation upon reaching the bottom of the trough defined by beam 55*a* and guide ribs 55*b* and 55*c*.

A first worker positioned at work station 54 takes guardrail sections 22 from vehicle 40 and places them in the frame 50. In particular, the worker at station 54 places each section 22 in a forward portion 50*a* of frame 50. The worker at station 54 then couples this section 22, e.g., by use of a come-along clamp 56 and splice bolts 26, to the previously placed section 22 at a rearward portion 50*b* of frame 50. Thus, as vehicle 40 moves in a forward direction 58 the worker at station 54 deploys rearward of vehicle 40 a continuous ribbon of joined sections 22, i.e., sections 22 coupled together at overlapping joints 24 by way of splice bolts 26. It is suggested that the worker at station 54 not completely tighten bolts 26 to allow some flexibility in the ribbon of joined sections 22 deployed rearward from vehicle 40.

Thus, at least two guardrail sections 22 are supported in orientation corresponding to their final mounting orientation and at substantially their intended mounting height. In this manner, the frame 50 supports joined sections 22 laterally adjacent their final mounting site and allows the worker at station 54 to conveniently establish alignment of the bolt apertures receiving splicing bolts 26. Also, the most rearward portion of frame 50 includes a roller cage 57 including, in this embodiment, four vertically oriented rollers 57*a*–57*d*, two on each side of the guardrail section 22. Roller cage 57 thereby captures laterally the section 22 and mechanically couples the deployed ribbon of joined sections 22 to the frame 50, yet allows longitudinal movement, i.e., deployment, of the joined sections 22.

A second worker located at work station 60 attaches the rearward deployed continuous ribbon of joined sections 22 to successive guardrail posts 10 as vehicle 40 moves in the forward direction 58. More particularly, the worker at station 60 mounts each support block 16 and inserts a post bolt 20 through the corresponding apertures of guardrail 18, block 16 and post 10 to successively mount the guardrail 18 at appropriate attachment sites of each post 10. The worker at work station 60 may also execute the task of final tightening of splice bolts 26 to complete a single-pass guardrail assembly and attachment process.

With the guardrail 18 in its proper orientation and height, movement laterally against the series of posts 10 positions the guardrail 18 for attachment. A positioning mechanism 70 includes a laterally extending telescopic support arm 72 having at its distal end a roller cage 74. Roller cage 74 includes vertically oriented rollers 74*a* and 74*b*, one on each side of section 22, to capture a section 22 therebetween. The roller cage 74 need not capture tightly the section 22 therein, the rollers 74*a* and 74*b* being separated slightly more than the thickness of section 22, to aid in positioning of guardrail 18 in coordination with movement of vehicle 40. Lateral, i.e., horizontal inward and outward, movement of arm 72 is accomplished by actuation of a hydraulic cylinder 76. The deployed ribbon of guardrail 18 is thereby moved selectively outward toward the series of prepositioned posts 10, or inward toward the vehicle 40. Control panel 77, operatively associated with positioning mechanism 70, permits operation of cylinders 76 and 80 by the worker at station 60. Such inward and outward lateral positioning of the deployed ribbon relative to the series of posts 10 is executed as necessary in coordination with movement of vehicle 40 in the forward direction 58.

Positioning mechanism 70 further includes a vertical hydraulic cylinder 80 carrying at its lower distal end the arm 72 and hydraulic cylinder 76. Cylinder 80 thereby provides vertical positioning of roller cage 74. Thus, by operation of hydraulic cylinders 76 and 80, the worker at station 60 can execute X-Y positioning of the roller cage 74 within a vertical plane transverse to forward direction 58 and coplanar with the cylinders 76 and 80. The roller cage 74 includes an upper opening 82 of sufficient width to allow passage therethrough of the laterally captured section 22. Thus, by lowering the roller cage 74 sufficient distance, the cage 74 can be disengaged from the guardrail 18.

It is contemplated that the workers at stations 54 and 60 employ impact wrenches, e.g., wrench 90 (FIG. 2), for manipulation of bolts 20 and 26. The vehicle 40, for example on trailer 40b, can carry an inventory of bolts 20*a* and nuts 20*b* and carry an inventory, for example on truck 40*a*, an inventory of bolts 26*a* and nuts 26*b*.

It is suggested that vehicle 40 include a remote operation panel 92, e.g., at the work station 54, for suitable remote control over movement of vehicle 40 as necessary to deploy the continuous ribbon of joined sections 22 in coordination with activity by the worker at station 60. This eliminates the need for a separate worker driving vehicle 40, or the need for one of the workers at stations 54 and 60 to intermittently enter the cab of vehicle 40 and move vehicle 40 in the forward direction 58.

In overall operation, the workers at stations 54 and 60 coordinate activities to accomplish the tasks of concurrently joining sections 22 to form the overlapping joints 24 and position the deployed ribbon of joined sections 22 as necessary for mounting to posts 10, including positioning of the intermediate support blocks 16. Generally, the worker at station 54 concentrates on the placement of each new section 22 in the forward portion 50*a* of frame 50 and on the forming of each overlapping joint 24. After each joint 24 is formed, the worker at station 54 moves vehicle 40 forward sufficient distance to allow placement of a next section 22 in the forward portion 50*a* of frame 50. Concurrently, the worker at station 60 mounts the deployed continuous ribbon of joined sections 22 to the prepositioned posts 10. Just after vehicle 40 moves forward and a portion of guardrail 18 is exposed to its attachment sites, the worker at station 60 moves arm 72 outward to position the exposed portion of guardrail 18 against the posts 10 and support blocks 16. The arm 72 is then retracted just prior to next advancing vehicle 40.

The assembly and mounting process operates smoothly and requires only two workers to accomplish rapid guardrail 18 construction. More particularly, the apparatus and method as illustrated herein requires approximately 0.1 hours per foot of guardrail 18 constructed, approximately half that of conventional guardrail assembly and mounting methods. The method and apparatus are well suited for the typically more difficult construction of tightly curved guardrails. Because conventional assembly and mounting methods normally constitute the most time consuming portion of the overall project, the method and apparatus of the present invention constitutes a significant improvement in the overall process. As a result of the method and apparatus of the present invention, the guardrail assembly and mounting crew is no longer a bottleneck in the construction project, being able to stay current with a preceding guardrail post placement crew. As a result, overall construction time, and therefore cost, for guardrail assembly and mounting is substantially reduced.

It will be appreciated that the present invention is not restricted to the particular embodiment that has been described and illustrated, and that variations may be made therein without departing from the scope of the invention as found in the appended claims and equivalents thereof.

What is claimed is:

1. An apparatus for guardrail assembly and attachment to at least one prepositioned guardrail post and in a given orientation, the guardrail assembly comprising guardrail sections joined together to form a continuous guardrail, the apparatus comprising:

a support frame receiving at least two guardrail sections and supporting said at least two guardrail sections in said given orientation;

a guardrail joint formation station maintaining said at least two guardrail sections in suitable relative orientation to permit joining of said at least two sections as a portion of said continuous guardrail; and a positioning and attachment station supporting said at least two guardrail sections as joined at said joint formation section and permitting positioning of at least one of said at least two guardrail sections against said at least one prepositioned guardrail post for attachment thereto as a portion of said guardrail assembly.

2. An apparatus according to claim 1 wherein said apparatus is movable along a series of prepositioned guardrail posts and said apparatus outputs a continuous ribbon of joined guardrail sections for sequential attachment to said series of prepositioned guardrail posts.

3. An apparatus according to claim 1 wherein said positioning and attachment station moves said at least one guardrail section laterally toward said at least one guardrail post for attachment thereto.

4. An apparatus according to claim 1 wherein said apparatus is a vehicle carrying an inventory of guardrail sections and said support frame is a support trough attached to a side of said vehicle facing said at least one guardrail post, said trough being pivotable in a horizontal plane to accommodate operation of said positioning and attachment station executing lateral movement of said at least two guardrail sections as joined laterally toward said at least one guardrail post.

5. An apparatus according to claim 1 wherein said support frame maintains said at least two guardrail sections substantially at a height corresponding to the height for said guardrail sections as mounted to said at least one guardrail post.

6. An apparatus according to claim 1 wherein said support frame comprises:

a first frame portion pivotally mounted for movement about a pivot point in a generally horizontal plane and including a first guardrail capturing portion allowing longitudinal movement of said guardrail therethrough but substantially restricting lateral movement of said guardrail section relative to said first frame portion; and a second frame portion including a second guardrail capturing mechanism allowing longitudinal movement of said guardrail section therethrough but restricting substantial lateral movement of said guardrail section relative to said second frame portion, and including an actuation mechanism for movement of said capturing mechanism generally within a horizontal plane whereby a length portion of a guardrail assembly supported by said first and second guardrail capturing mechanisms couple said first and second frame portions in such manner that operation of said actuation mechanism accomplishes said pivotal movement of said first frame portion.

7. A method of guardrail assembly and mounting to prepositioned guardrail posts, the guardrail comprising guardrail sections joined together to form a continuous guardrail in a given orientation, the method comprising the steps of:

supporting by frame structure at least two guardrail sections in said given orientation laterally adjacent a site of attachment to said prepositioned guardrail posts;

joining together said at least two guardrail sections;

exposing to said site of attachment a portion of said at least two guardrail sections as joined in said joining step;

moving said portion of said at least two guardrail sections into an attachment position at said site of attachment; and attaching said portion of said at least two guardrail sections to said attachment site.

8. A method according to claim 7 further comprising the steps of:

sequentially joining a series of said guardrail sections as a continuous guardrail in said given orientation;

sequentially exposing to and positioning for attachment portions of said continuous guardrail to corresponding sites of attachment concurrent with said sequentially joining step; and sequentially attaching said portions to said corresponding sites of attachment concurrent with said steps of joining and exposing.

9. A method according to claim 7 wherein said steps of sequentially joining, exposing, and attaching are executed by the steps of:

moving a vehicle along a series of prepositioned guardrail posts, the vehicle carrying an inventory of said guardrail sections and providing as output a continuous ribbon of joined guardrail sections;

bringing said continuous ribbon laterally against said attachment sites of said series of guardrail posts; and attaching said continuous ribbon to said attachment sites.

10. An apparatus for guardrail assembly and attachment to a series of prepositioned guardrail posts and in a given orientation, the guardrail assembly comprising guardrail sections joined together by overlapping joints to form a continuous guardrail ribbon, the apparatus comprising:

a vehicle carrying an inventory of said guardrail sections;

a rail support frame carried by said vehicle and supporting at least two of said guardrail sections in said given orientation whereby one of said overlapping joints may be formed between said at least two guardrail sections and a continuous ribbon of joined guardrail sections may be deployed rearward of said vehicle and attached to said series of prepositioned guardrail posts as said vehicle moves forward while ones of said guardrail sections are first positioned in a forward portion of said support frame then joined to a preceding one of said guardrail sections previously placed in said support frame.

11. An apparatus according to claim 10 wherein said support frame is mounted to said vehicle for movement in a horizontal plane and said apparatus further comprises a frame positioning mechanism for urging said continuous ribbon against said prepositioned guardrail posts for attachment thereto.

12. A method of guardrail assembly and attachment to a series of prepositioned guardrail posts and in a given orientation, the guardrail assembly comprising guardrail sections joined together by overlapping joints to form a continuous guardrail ribbon, the method comprising the steps:

moving a vehicle carrying an inventory of said guardrail sections along said series of guardrail posts;

joining ones of said guardrail sections to form a continuous ribbon of guardrail sections;

deploying rearward of said moving vehicle said continuous ribbon of joined guardrail sections; and attaching said continuous ribbon to said series of guardrail posts.

13. A method according to claim 12 further comprising the step of urging said continuous ribbon of joined guardrail sections laterally outward relative to said vehicle and toward said series of prepositioned guardrail posts for attachment thereto.

14. A method according to claim 12 wherein said attaching step includes mounting of an intermediate support block between each of said prepositioned guardrail posts and said continuous ribbon of joined guardrail sections.

* * * * *